US008863432B2

(12) United States Patent
An

(10) Patent No.: US 8,863,432 B2
(45) Date of Patent: Oct. 21, 2014

(54) CLEANING APPARATUS FOR CARTRIDGE CHAMBER OF ARTILLERY

(71) Applicant: Soosung Machinery Co., Ltd., Ulsan (KR)

(72) Inventor: Sang Jin An, Ulsan (KR)

(73) Assignee: Soosung Machinery Co., Ltd., Ulsan (KR)

( * ) Notice: Subject to any disclaimer, the term of this patent is extended or adjusted under 35 U.S.C. 154(b) by 0 days.

(21) Appl. No.: 13/854,014

(22) Filed: Mar. 29, 2013

(65) Prior Publication Data

US 2014/0053353 A1 Feb. 27, 2014

(30) Foreign Application Priority Data

Aug. 21, 2012 (KR) ..... 10-2012-0091101

(51) Int. Cl.
*F41A 31/02* (2006.01)
*F41A 29/02* (2006.01)

(52) U.S. Cl.
CPC ..... *F41A 29/02* (2013.01)
USPC ..... 42/95; 15/104.05; 15/104.09

(58) Field of Classification Search
USPC ..... 42/95; 15/104.05, 104.09, 106, 164
See application file for complete search history.

(56) References Cited

U.S. PATENT DOCUMENTS

| | | | | |
|---|---|---|---|---|
| 7,520,082 | B2 * | 4/2009 | An | 42/95 |
| 7,520,203 | B2 * | 4/2009 | An | 89/1.3 |
| 7,958,664 | B2 * | 6/2011 | An | 42/95 |
| 8,434,256 | B2 * | 5/2013 | An | 42/95 |

FOREIGN PATENT DOCUMENTS

KR 10-2002-0034131 A 5/2002

* cited by examiner

*Primary Examiner* — Michael David
(74) *Attorney, Agent, or Firm* — Flaster/Greenberg PC

(57) ABSTRACT

A cleaning apparatus for a cartridge chamber of artillery, including: a rotary member having a power supply part mounted thereinto and a motor rotated by receiving the power from the power supply part; a cleaning member having a rotary body operated cooperatively with the rotation of the motor, slant cleaning parts coupled slantly to the front portion of the outer periphery of the rotary body, and parallel cleaning parts coupled to the rear portion of the outer periphery of the rotary body; and a handle member coupled to the rear portion of the rotary member in such a manner as to be adjusted in length in a telescoping manner, whereby the slant portion and the parallel portion formed on the internal peripheral surface of the cartridge chamber are all cleaned at the same time.

9 Claims, 2 Drawing Sheets

(A)

CLEANING APPARATUS FOR CARTRIDGE CHAMBER OF ARTILLERY

CROSS-REFERENCE TO RELATED APPLICATIONS

This application is based on and claims priority from Korean Patent Application No. 10-2012-0091101, filed on Aug. 21, 2012 in the Korean Intellectual Property Office, the disclosure of which is incorporated herein in its entirety by reference.

BACKGROUND OF THE INVENTION

Field of the Invention

1. Technical Field

The present invention relates to a cleaning apparatus for a cartridge chamber of artillery, and more particularly, to a cleaning apparatus for a cartridge chamber of artillery that is capable of at the same time cleaning a slant portion and a parallel portion formed on the internal peripheral surface of the cartridge chamber.

Description of Related Art

2. Description of the Related Art

In general, artillery has a cartridge chamber formed on the rear side of a gun barrel, and the cartridge chamber has a space portion having a larger diameter than the gun barrel from which shells are fired. Accordingly, the cartridge chamber is not cleanable by means of an apparatus for cleaning the gun barrel, and the cleaning of the cartridge chamber is thus performed by means of a worker's hand with a non-woven fabric to which a cleaning liquid is applied.

In case of performing the cleaning of the cartridge chamber through the worker's hand, however, the cleaning is done in a manually operated manner in a substantially narrow space, thereby providing no perfect cleaning results. Further, the cleaning liquid is unavoidably applied to the worker's hand, and the cleaning is conducted with the application of a large force, which make the cleaning operation very hard and need much time for the cleaning. Also, if the worker's hand is stained with the cleaning liquid, a disease like dermatitis may occur, which of course causes the loss of armed force.

So as to solve the above-mentioned problems, accordingly, there has been proposed Korean Patent Publication Laid-Open No. 2002-0034131 which is entitled 'Cleaning apparatus for cartridge chamber of artillery', as filed by the same applicant as the present invention.

According to the conventional cleaning apparatus, however, since the internal peripheral surface of the cartridge chamber is divided into a slant portion and a parallel portion, both of the two portions are not cleaned perfectly.

Further, the foreign materials existing inside the cartridge chamber may enter the interior of a muzzle.

Furthermore, it is hard to keep and install the cleaning apparatus for the cartridge chamber.

BRIEF SUMMARY OF THE INVENTION

1. Technical Problem

Accordingly, the present invention has been made in view of the above-mentioned problems occurring in the prior art, and it is an object of the present invention to provide a cleaning apparatus for a cartridge chamber of artillery that is capable of at the same time cleaning a slant portion and a parallel portion formed on the internal peripheral surface of the cartridge chamber, while preventing the foreign materials existing inside the cartridge chamber from entering the interior of a muzzle and performing the storage and installation thereof in a convenient manner.

2. Technical Solution

To accomplish the above object, according to the present invention, there is provided a cleaning apparatus for a cartridge chamber of artillery, including: a rotary member having a power supply part mounted thereinto and a motor rotated by receiving the power from the power supply part; a cleaning member having a rotary body operated cooperatively with the rotation of the motor, slant cleaning parts coupled slantly to the front portion of the outer periphery of the rotary body, and parallel cleaning parts coupled to the rear portion of the outer periphery of the rotary body in such a manner as to have both ends parallel with each other; and a handle member coupled to the rear portion of the rotary member in such a manner as to be adjusted in length in a telescoping manner, whereby the slant portion and the parallel portion formed on the internal peripheral surface of the cartridge chamber are all cleaned at the same time.

According to the present invention, desirably, each slant cleaning part includes a slant case coupled slantly to the rotary body, slant springs mounted inside the slant case, and slant brushes coupled in compressed and released manners to the slant springs.

According to the present invention, desirably, each parallel cleaning part includes a parallel case coupled in parallel to the rotary body, parallel springs mounted inside the parallel case, and parallel brushes coupled in compressed and released manners to the parallel springs.

According to the present invention, desirably, a stopper is disposed between the slant case and the parallel case and has a rotary roller mounted thereon, so that through the rotation of the rotary body, the stopper is rotated in the cartridge chamber.

According to the present invention, desirably, the cleaning member further includes a cleaning part in which a cleaning liquid is contained to spray the cleaning liquid to the outside by means of the centrifugal force of the rotary body.

According to the present invention, desirably, the cleaning member further includes a sealing member made of a silicone material formed on the front side thereof to prevent foreign materials from entering the interior of the muzzle.

According to the present invention, desirably, the handle member is formed of a hollow interior in such a manner as to communicate with the rear portion of the rotary member, so that an electric wire is connected to the power source part mounted in the rotary member.

According to the present invention, desirably, the handle member has a foldable function of being folded and unfolded in a narrow space in such a manner as to be separable from the rotary member, thereby making it convenient to be inserted by a desired dept into the narrow space.

3. Advantageous Effect

According to the present invention, there is provided the cleaning apparatus for a cartridge chamber of artillery that has the following advantages:

First, through the movement of the cleaning apparatus in the narrow space of the cartridge chamber, the interior of the cartridge chamber can be rapidly and perfectly cleaned, thereby providing many conveniences in use.

Second, the slant portion and the parallel portion formed on the internal peripheral surface of the cartridge chamber are all cleaned perfectly, thereby increasing the durability of the cartridge chamber.

Third, the cleaning liquid can be sprayed with no separate member.

Last, the brushes can be rapidly exchanged to achieve the easy access of a worker to the cleaning apparatus.

DETAILED DESCRIPTION OF THE INVENTION

Hereinafter, an explanation on a cleaning apparatus for a cartridge chamber of artillery according to the present invention will be in detail given with reference to the attached drawings.

Figure 1:
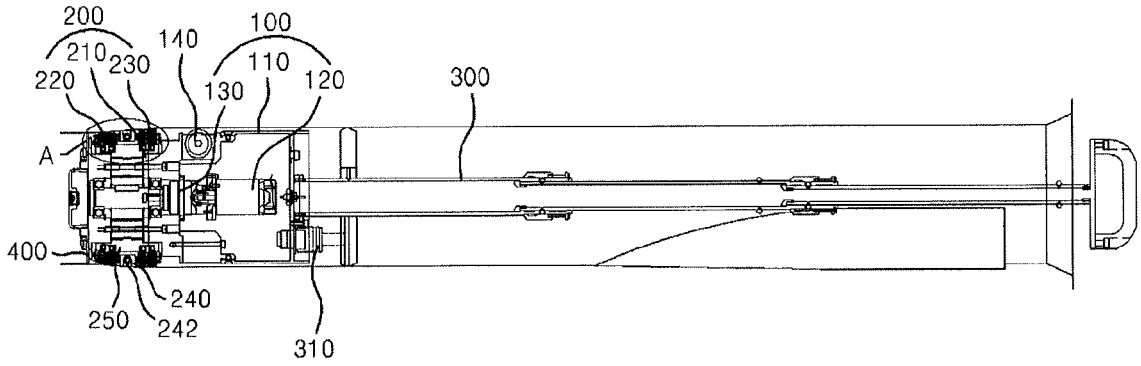
FIG. 1 is a sectional view showing a cleaning apparatus for a cartridge chamber of artillery according to the present invention.
Figure 2:
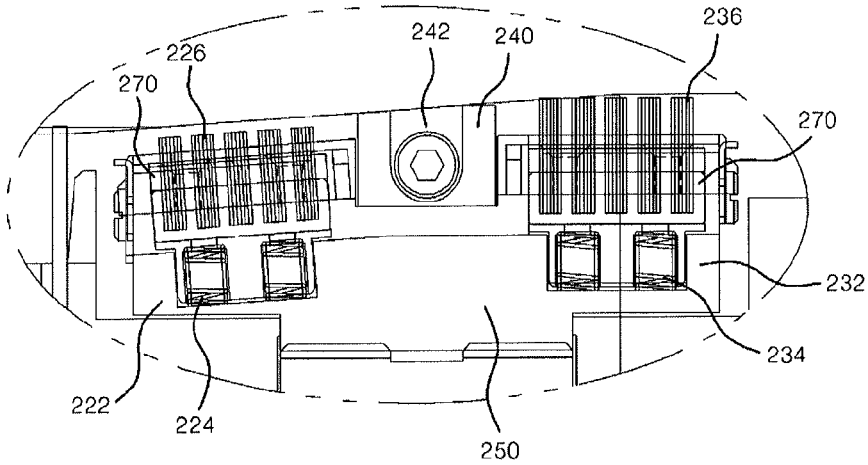
FIG. 2 is an enlarged sectional view showing a portion of the cleaning apparatus for a cartridge chamber of artillery according to the present invention.
Figure 3:
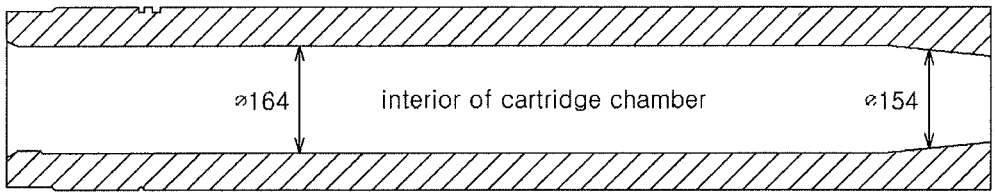
FIG. 3 is a conceptual view showing the interior of the cartridge chamber.

FIG. 1 is a sectional view showing a cleaning apparatus for a cartridge chamber of artillery according to the present invention, FIG. 2 is an enlarged sectional view showing a portion of the cleaning apparatus for a cartridge chamber of artillery according to the present invention, and FIG. 3 is a conceptual view showing the interior of the cartridge chamber.

As shown in FIGS. 1 to 3, there is provided a cleaning apparatus for a cartridge chamber of artillery according to the present invention, including: a rotary member 100 having a power supply part 120 mounted thereinto and a motor 130 rotated by receiving the power from the power supply part 120; a cleaning member 200 having a rotary body 210 operated cooperatively with the rotation of the motor 130, slant cleaning parts 220 coupled slantly to the front portion of the outer periphery of the rotary body 210 and parallel cleaning parts 230 coupled to the rear portion of the outer periphery of the rotary body 210 in such a manner as to have both ends parallel with each other; and a handle member 300 coupled to the rear portion of the rotary member 100 in such a manner as to be adjusted in length in a telescoping manner, whereby the slant portion and the parallel portion formed on the internal peripheral surface of the cartridge chamber are all cleaned at the same time.

In this case, the cleaning apparatus according to the present invention is applicable to the cartridge chamber of the artillery in a range between 76 mm and 108 mm, and as shown in FIG. 3, the cartridge chamber is designed to have the same diameter from the inlet to a given distance and to be tapered after the given distance.

Hereinafter, an explanation on each member according to the present invention will be given.

The rotary member 100 is made of a metal material having excellent strength and hardness and has a body 110 having a generally circular section and a hollow interior, the power supply part 120 adapted to supply power to the respective members by receiving the power from the interior of the body 110, and the motor 130 mounted at the front side of the body 110 in such a manner as to be rotated by receiving the power from the power supply part 120.

In this case, the body 110 has wheels 140 mounted on the outer periphery thereof in such a manner as to be moved forwardly and backwardly in the cartridge chamber.

Further, the power supply part 120 may be formed of batteries, but so as to supply large power, it is connected by means of an electric wire (not shown) to the outside in such a manner as to receive power thereto.

The cleaning member 200 has the rotary body 210 operated cooperatively with the rotation of the motor 130, the slant cleaning parts 220 coupled slantly to the front portion of the outer periphery of the rotary body 210, and the parallel cleaning parts 230 coupled to the rear portion of the outer periphery of the rotary body 210 in such a manner as to have both ends parallel with each other.

Accordingly, the slant cleaning parts 220 and the parallel cleaning parts 230 are mounted plurally along the outer periphery of the rotary body 210.

In this case, the rotary body 210 is rotatably coupled to the motor 130 in such a manner as to be operated cooperatively with the rotation of the motor 130, and the rotary body 210 is coupled to a slant case 222 of each slant cleaning part 220 as will be discussed later and to a parallel case 232 of each parallel cleaning part 230 as will be discussed later.

The slant cleaning parts 220 and the parallel cleaning parts 230 are rotated at the same time by means of the rotary body 210. Accordingly, they may be formed of a single member on which a slant portion and a parallel portion are divided. Alternatively, they may be independently separated from each other.

The range to the slant portion after a given distance from the inlet of the cartridge chamber of the artillery is cleaned by means of the slant cleaning parts 220, thereby preventing the muzzle from being malfunctioned due to the foreign materials existing inside the cartridge chamber thereof.

Desirably, each slant cleaning part 220 includes the slant case 222 coupled slantly to the rotary body 210, slant springs 224 mounted inside the slant case 222, and slant brushes 226 coupled in compressed and released manners to the slant springs 224.

Desirably, each parallel cleaning part 230 includes the parallel case 232 coupled in parallel to the rotary body 210, parallel springs 234 mounted inside the parallel case 232, and parallel brushes 236 coupled in compressed and released manners to the parallel springs 234.

As the cartridge chamber has different inner diameters, the slant brushes 226 and the parallel brushes 236 are rotated in the state where the slant springs 224 and the parallel springs 234 are compressed by the different inner diameters, thereby cleaning the interior of the cartridge chamber.

Further, the slant brushes 226 and the parallel brushes 236 are detachably coupled to the slant case 222 and the parallel case 232, so that if they are worn out, they can be can be exchanged with new ones.

Also, the slant brushes 226 and the parallel brushes 236 have a separation cap 270 mounted on the undersides thereof, so that they can be detachably mounted on the slant case 222 and the parallel case 232. That is, the slant case 222 and the parallel case 232 have a groove formed on the inner periphery thereof, into which the separation cap 270 is fittingly inserted, so that the slant brushes 226 and the parallel brushes 236 can be detachably mounted on the slant case 222 and the parallel case 232.

More desirably, a stopper 240 is further disposed between the slant case 222 and the parallel case 232 and has a rotary roller 242 mounted thereon, thereby being rotated in the cartridge chamber by means of the rotation of the rotary body 210.

The stopper 240 has a slant outer peripheral surface, which is more protruded than the outer periphery of the slant case 222.

Even if the cleaning member 200 continuously enters the cartridge chamber, accordingly, the stopper 240 is locked to the slant portion of the cartridge chamber, thereby preventing the cleaning member 200 from further entering the cartridge chamber.

Further, the stopper 240 has the rotary roller 242, thereby preventing the rotation of the rotary body 210 from being interfered. That is, if the cleaning member 200 comes in close contact with the inner periphery of the cartridge chamber by means of the stopper 240, the motor 130 is idle, but the stopper 240 is rotated in the cartridge chamber by means of the rotary roller 242.

Desirably, the cleaning member 200 further includes a cleaning part 250 in which a cleaning liquid is contained, and thus, the cleaning liquid is sprayed to the outside by means of the centrifugal force of the rotary body 210.

Therefore, the slant cleaning parts 220 and the parallel cleaning parts 230 perform the cleaning operation of the interior of the cartridge chamber by means of the rotation of the rotary body 210, and in this case, after the cleaning liquid is sprayed and coated on the interior of the cartridge chamber to remove the oil mist existing thereinto, the cleaning is performed by means of the brushes of the slant cleaning parts 220 and the parallel cleaning parts 230.

The cleaning member 200 has the cleaning part 250 on which holes are formed, so that the cleaning liquid contained in the cleaning part 250 is sprayed to the outside by means of the centrifugal force of the rotary body 210.

According to the present invention, the cleaning part 250 is formed over a given region below the stopper 240, thereby helping the efficient cleaning of the slant cleaning parts 220 and the parallel cleaning parts 230.

Further, the cleaning member 200 further includes a sealing member 400 made of a silicone material formed on the front side thereof, thereby preventing foreign materials from entering the interior of the muzzle.

If the cartridge chamber is cleaned by the cleaning member 200, all kinds of foreign materials are generated and enter the muzzle. At this time, the sealing member 400 is formed on the front surface of the cleaning member 200, thereby preventing the foreign materials from entering the muzzle.

In this case, the sealing member 400 is made of a soft silicone material and has a larger diameter than the cartridge chamber of the muzzle side, thereby sealing the interior of the cartridge chamber at the muzzle side.

According to the present invention, the handle member 300 is disposed on the rear side of the rotary member 100 in such a manner as to be adjustable in length in a telescoping manner.

Since the width of the outside of the cartridge chamber is smaller than the length of the cartridge chamber, accordingly, a long handle cannot be inserted into the cartridge chamber. Thus, the cleaning is performed by forcedly inserting a worker's arm into the end of the interior of the cartridge chamber, but according to the present invention, the handle member 300 is adjusted in length in the telescoping manner, thereby being sequentially extended in the cartridge chamber.

That is, the handle member 300 is folded to a relatively short length, and next, it is extended to multi-steps into the cartridge chamber, thereby performing the cleaning up to the end of the interior of the cartridge chamber.

Desirably, the handle member 300 is formed of a hollow interior in such a manner as to communicate with the rear portion of the rotary member 100, so that the electric wire is connected to the power source part 120.

This provides the power larger than separate batteries, and further, as the handle member 300 is formed of the hollow interior in such a manner as to communicate with the rear portion of the rotary member 100, the electric wire is desirably connected to the power source part 120.

Desirably, the handle member 300 is separable from the rotary member 100. This permits the cleaning apparatus to be easily kept. Accordingly, the front side of the handle member 300 and the rear side of the rotary member 100 are coupled by means of a bolt 310, and if necessary, they are separable from each other.

As mentioned above, the cleaning apparatus for a cartridge chamber of artillery according to the present invention is capable of at the same time cleaning the slant portion and the parallel portion formed on the internal peripheral surface of the cartridge chamber, while preventing the foreign materials existing inside the cartridge chamber from entering the interior of a muzzle and performing the storage and installation thereof in a convenient manner.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A cleaning apparatus for a cartridge chamber of artillery, comprising:

a rotary member having a power supply part mounted thereinto and a motor rotated by receiving the power from the power supply part;

a cleaning member having a rotary body operated cooperatively with the rotation of the motor, slant cleaning parts coupled slantly to the front portion of the outer periphery of the rotary body, and parallel cleaning parts coupled to the rear portion of the outer periphery of the rotary body in such a manner as to have both ends parallel with each other; and a handle member coupled to the rear portion of the rotary member in such a manner as to be adjusted in length in a telescoping manner, whereby the slant portion and the parallel portion formed on the internal peripheral surface of the cartridge chamber are all cleaned at the same time.

2. The cleaning apparatus according to claim 1, wherein each slant cleaning part comprises a slant case coupled slantly to the rotary body, slant springs mounted inside the slant case, and slant brushes coupled in compressed and released manners to the slant springs.

3. The cleaning apparatus according to claim 2, wherein a stopper is disposed between the slant case and a parallel case and has a rotary roller mounted thereon, so that through the rotation of the rotary body, the stopper is rotated in the cartridge chamber.

4. The cleaning apparatus according to claim 1, wherein each parallel cleaning part comprises a parallel case coupled in parallel to the rotary body, parallel springs mounted inside the parallel case, and parallel brushes coupled in compressed and released manners to the parallel springs.

5. The cleaning apparatus according to claim 4, wherein a stopper is disposed between the slant case and the parallel case and has a rotary roller mounted thereon, so that through the rotation of the rotary body, the stopper is rotated in the cartridge chamber.

6. The cleaning apparatus according to claim 1, wherein the cleaning member further comprises a cleaning part in which a cleaning liquid is contained to spray the cleaning liquid to the outside by means of the centrifugal force of the rotary body.

7. The cleaning apparatus according to claim 1, wherein the cleaning member further comprises a sealing member made of a silicone material formed on the front side thereof to prevent foreign materials from entering the interior of a muzzle.

8. The cleaning apparatus according to claim 1, wherein the handle member is formed of a hollow interior in such a manner as to communicate with the rear portion of the rotary member, so that an electric wire is connected to the power source part mounted into the rotary member.

9. The cleaning apparatus according to claim 8, wherein the handle member is separable from the rotary member.

* * * * *